US005722219A

United States Patent [19]

Dobransky

[11] Patent Number: 5,722,219

[45] Date of Patent: Mar. 3, 1998

[54] METHOD OF MAKING A DRINKING STRAW

[76] Inventor: Mark J. Dobransky, 955 W. Lancaster Rd., Ste. 300, Orlando, Fla. 32809

[21] Appl. No.: 758,889

[22] Filed: Dec. 2, 1996

[51] Int. Cl.[6] ..... B65B 11/10

[52] U.S. Cl. ..... 53/461; 206/446; 229/103.1; 283/74; 283/79

[58] Field of Search ..... 53/133.6, 133.8, 53/412, 492, 411, 461; 206/306, 446; 229/89, 87.05, 87.12, 103.1; 493/270; 426/85; D7/300.2; D9/305, 433, 431; 283/74, 79

[56] References Cited

U.S. PATENT DOCUMENTS

| | | | |
|---|---|---|---|
| 1,436,644 | 11/1922 | Bricken | 53/492 |
| 1,466,185 | 8/1923 | Pick . | |
| 2,057,121 | 10/1936 | Trevellyan | 53/412 |
| 2,066,991 | 1/1937 | Lutz | 493/274 |
| 3,228,308 | 1/1966 | Denenberg | 493/274 |
| 4,165,000 | 8/1979 | Poncy | 206/306 |
| 4,211,024 | 7/1980 | Nickell | 40/406 |
| 5,054,264 | 10/1991 | Miller | 53/412 |
| 5,318,499 | 6/1994 | Rice et al. | 493/299 |

*Primary Examiner*—Linda Johnson
*Assistant Examiner*—John Paradiso
*Attorney, Agent, or Firm*—William M. Hobby, III

[57] ABSTRACT

A method of making a drinking straw includes the steps of selecting a flat material suitable for making a drinking straw, printing indicia on the flat material in a position to form the end portions of the straw so that each end of the straw will have indicia indicating a different type of drink thereon and then forming the flat material into a straw with indicia on each end indicating a different type of drink, such as a diet or regular cola, so that a straw can distinguish a drink by the end of the straw protruding from the drink container. The straw can also be color coded and can be printed on an elongated flat material which is spiraled on a mandrel to form the straw. A straw wrapper can be imprinted on both ends in a similar manner and one end pulled back leaving the indicia on the other end.

9 Claims, 1 Drawing Sheet

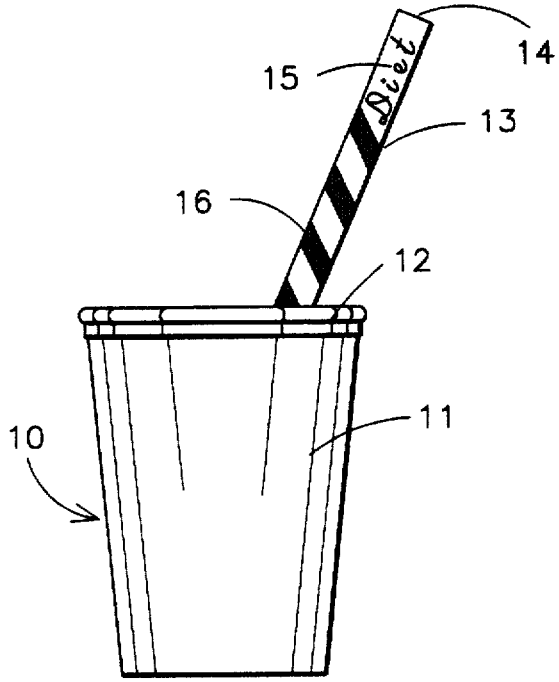
FIG. 1
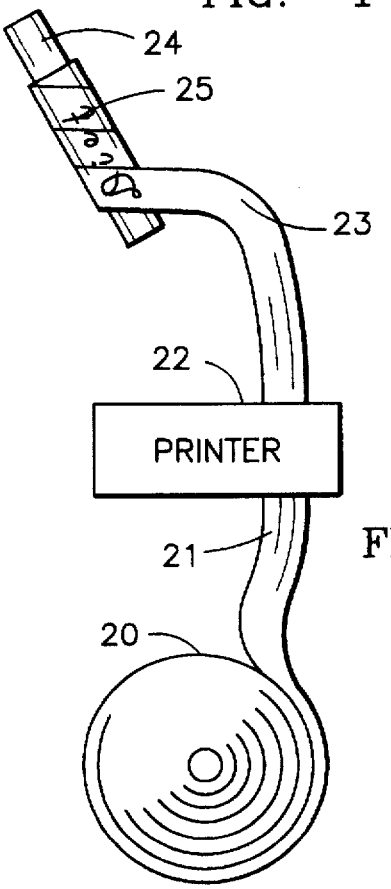
FIG. 3
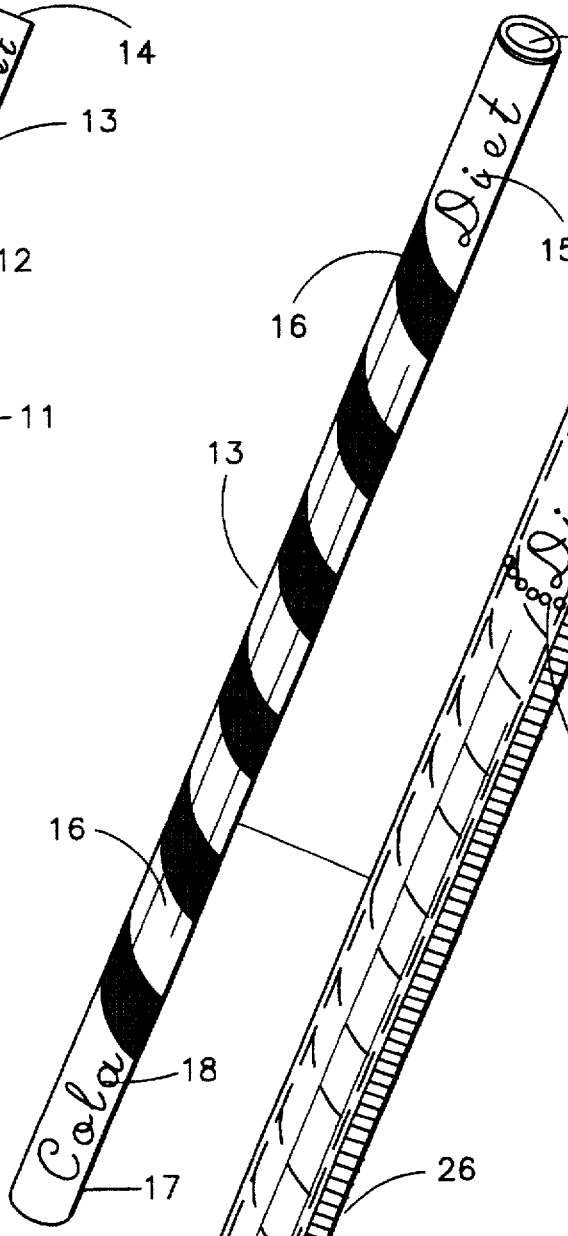
FIG. 2
FIG. 4

METHOD OF MAKING A DRINKING STRAW

BACKGROUND OF THE INVENTION

The present invention relates to a method of making a drinking straw and especially to a method of making a drinking straw having printed indicia on each end thereof to indicate the type of drink in a container.

In the past, a wide variety of drinking straws have been provided which straws are commonly made of a coated paper material which has been formed from an elongated piece of material which has been coiled to form a cylindrical hollow straw. It is also common to make straws of a solid polymer or plastic material which straws are extruded to form an elongated cylindrical shape. There have also been a variety of special straws including those having a bending portion formed into a plastic straw which consists of an accordion like shape formed into the middle of the straw to allow the straw to be bent without crimping the straw and blocking the passage of fluid therethrough. There are also plastic straws having unusual shapes formed therein and made in a variety of colors for the amusement of the user.

Prior art drinking straws can be seen in the U.S. patent to Pick, U.S. Pat. No. 1,466,185, which straw includes printing with ink on a web of paper used to make the straw so that one end of the straw has colored stripes formed thereon. This straw is formed by wrapping the material onto a form and securing the wrapped paper together by an adhesive. The entire straw is then coated with a paraffin which coating covers the printing ink of the markings on the straw. The straw is made to differentiate that portion of the straw which is to be placed in the mouth of the user from the remainder of the straw. In the Nickell patent, U.S. Pat. No. 4,211,024, a magic drinking straw is provided which has a hollow box connected to the straw such that fluid can be drawn through the box. The viewed face of the box has transparent indica surrounded by solid black or dark colored material so that the indicia is visible when a colored fluid, such as milk, is drawn through the straw and box.

The present invention deals with a method of making a straw in which the brand and type of drink can be indicated by the portion of the straw protruding from a cup with each end of the straw having a different indication, such as diet cola on one end and cola on the other. The indicia may also indicate the brand of drink and may be color coded with a brand's color. When a waitress serves a tray of drinks, some of which may be diet and others which may not, she can give the patrons assurances of which drinks are diet or which are cola by the portion of the straw protruding from the containers.

SUMMARY OF THE INVENTION

A method of making a drinking straw includes the steps of selecting a flat material suitable for making a drinking straw, printing indicia on the flat material in a position to form the end portions of the straw so that each end of the straw will have indicia indicating a different type of drink thereon and then forming the flat material into a straw with indicia on each end indicating a different type of drink, such as a diet or regular cola, so that a straw can distinguish a drink by the end of the straw protruding from the drink container. The straw can also be color coded and can be printed on an elongated flat material which is spiraled on a mandrel to form the straw. A straw wrapper can be imprinted on both ends in a similar manner and one end pulled back leaving the indicia on the other end.

BRIEF DESCRIPTION OF THE DRAWINGS

Other objects, features, and advantages of the present invention will be apparent from the written description and the drawings in which:

FIG. 1 is a perspective view of a drink container having a straw therein made in accordance with the present method;

FIG. 2 is a perspective view of the straw made in accordance with the present method;

FIG. 3 is a diagrammatic view of a method of making a straw in accordance with the present invention; and FIG. 4 is a strew covered with the straw wrapper of the present invention.

DESCRIPTION OF THE PREFERRED EMBODIMENT

Referring to FIG. 1, a drink container 10 may be a plastic, glass or metal container 11 having a plastic cap 12 covering the container 11 to prevent the spilling of the liquid contained therein and having a straw 13 passing through the cap 12 into the container 11. The straw 13 has a first end 14 and has indicia 15 imprinted thereon indicating diet and may also have colored stripes 16 thereon. As seen in FIG. 2, the straw 13 has the end 14 having the indicia 15 indicating diet cola while the opposite end 17 of the straw 13 has indicia 18 indicating cola. The straw is cylindrical shaped and has a band 16. The indicia 15 and 18 can also be color coded and may indicate a particular brand name, such as diet Pepsi or diet Coke and can be done in the brand name colors; i.e. red for coke.

As seen in FIG. 3, a method of making straws of this type includes selecting a flat material for making the straw which is a flat roll of material 20, such as a paper, with the strip of paper being fed at 21 into a printer 22. The paper strip 23 is printed on predetermined portions so that when the material 23 is wrapped on a mandrel 24, the indicia 25 has been printed so that it aligns to print the word "diet", as shown in FIG. 3, and can also print the coiled bands 16. When a straw is made, as shown in FIG. 3, the material typically is a plastic or paper material 23 which is wrapped onto a mandrel 24 and may be adhesively attached when coiled or spiraled onto the mandrel and is typically coated with a wax. Alternatively, a precoated wax material can be used to form the straw on the mandrel 24. In the case of plastic straws, the straws are formed through plastic extrusion and cut to size as they come off the extruding machine. The plastic straws are then fed by rolling the straws into a silk screen printer where the diet or cola are printed on each end of each straw after the forming of the straw.

Referring to FIG. 4, a straw having a paper wrapper or covering thereover and has been printed at each end to indicate to a person using the straw which end to rapidly open to properly insert the straw into the container of FIG. 1. In addition, by printing indicia on the paper wrapper for the straw, the wrapper can be pulled back from the appropriate end to leave the straw covered at one end with only the indicia at one end showing to indicate the type of drink in the container of FIG. 1. Perforations 30 and 31 at either end of the wrapper allow the end wrapper portion to be easily pulled off. The wrapper is then pulled back on the straw. The paper wrapping 26 in FIG. 4 has the indicia 27 printed thereon at one end and the indicia 28 printed on the other end thereof and can easily be opened from either end to leave the covering as a cap for the straw in the container so that the patron can properly identify it from the wrapper which acts as a cap to protect the drink being delivered to a patron.

It should be clear at this time that a method of making a drinking straw has been provided which has different indicia on each end thereof and is coded to indicate the type of drink in the container. However, the straw or the wrapper for the straw can also be used to distinguish between types of drinks, such as Pepsi, coke, coffee, coffee coolers, or a type of mixed drink, such as orange juice or orange juice and vodka, to thereby indicate whether a drink contains an alcoholic beverage. However, the present invention is not to be construed as limited to the forms shown which are to be considered illustrative rather than restrictive.

I claim:

1. A method of making a drinking straw comprising the steps of:

selecting flat material suitable for making a drinking straw, said flat material having portions positioned to form the end portions of a straw;

printing indicia on said flat material portions positioned to form the end portions of a straw which indicia indicates a different type of drink on each end portion;

forming said flat material into a straw having indicia on each end thereof indicating a different type of drink on each end; whereby a straw is made which can distinguish a drink by the end of the straw protruding from a drink container.

2. A method of making a drinking straw in accordance with claim 1 in which the step of printing includes printing color coding on each end portion of said flat material whereby each end is color coded for a type of drink.

3. A method of making a drinking straw in accordance with claim 2 in which the step of printing color coding on each end portion of said flat material includes printing color coding indicating a brand of drink whereby each end is color coded for a type of drink.

4. A method of making a drinking straw in accordance with claim 2 in which the step of printing includes printing one said end portion of said flat material to indicate a diet drink.

5. A method of making a drinking straw in accordance with claim 2 in which the step of forming said flat material into a straw includes rolling said flat material to form a straw.

6. A method of making a drinking straw in accordance with claim 2 in which the step of forming said flat material into a straw includes spiraling said flat material to form a straw.

7. A method of making a drinking straw in accordance with claim 1 including the steps of:

selecting paper for covering said drinking straw;

printing indicia on said paper to match the indicia on said drinking straw;

forming a drinking straw cover from said selected and printed paper shaped to fit over said drinking straw; and covering said drinking straw with said formed straw cover with the indicia on said drinking straw cover aligned with the indicia of said printed on said drinking straw.

8. A method of making a drinking straw in accordance with claim 7 including the step of pulling said cover on said drinking straw back from one end to leave the other end of said drinking straw covered to thereby leave the indicia displayed on one end of said cover.

9. A method of making a wrapped drinking straw comprising the steps of:

selecting a drinking straw suitable for printing indicia thereon;

selecting flat material suitable for making a drinking straw wrapper, said flat material having portions positioned to form the end portions of a straw wrapper;

printing indicia on said flat material portions positioned to form the end portions of a straw wrapper which indicia indicates a different type of drink on each end portion;

forming said flat material into a straw wrapper having indicia on each end thereof indicating a different type of drink on each end portion;

covering said selected straw with said printed straw wrapper;

sliding a portion of said straw wrapper from one end along said straw to uncover one end of said straw; and placing said straw uncovered portion in a drinking container with the straw wrapper covering the portion of the straw extending from said container with the indicia thereon indicating the type of drink in said container, whereby a straw wrapper can distinguish a drink by the wrapper over the end of the straw protruding from a drink container.

* * * * *